US005861565A

United States Patent [19]

Omiya et al.

[11] Patent Number: 5,861,565

[45] Date of Patent: Jan. 19, 1999

[54] SYNCHRONIZER RING

[75] Inventors: Takao Omiya; Kunihiro Iguchi; Tetsuo Masuyama, all of Shimotsuga-gun, Japan

[73] Assignee: Nippon Piston Ring Co., Ltd., Japan

[21] Appl. No.: 865,030

[22] Filed: May 29, 1997

[30] Foreign Application Priority Data

May 30, 1996 [JP] Japan ..... 8-136080
Oct. 8, 1996 [JP] Japan ..... 8-267181

[51] Int. Cl.[6] ..... C22C 38/16

[52] U.S. Cl. ..... 75/243; 148/332; 420/89; 420/99; 75/246

[58] Field of Search ..... 75/236, 243, 246; 148/332; 420/89, 99

[56] References Cited

U.S. PATENT DOCUMENTS 4,648,903 3/1987 Ikenoue et al. ..... 75/246
4,964,908 10/1990 Greethan ..... 75/246
5,007,956 4/1991 Fujita et al. ..... 75/246
5,370,725 12/1994 Kawamura et al. ..... 75/246

*Primary Examiner*—George Wyszomierski
*Attorney, Agent, or Firm*—Nixon & Vanderhye

[57] ABSTRACT

A synchronizer ring performing synchronous sliding operation with and separating operation from a rotating object member, is composed of an Fe sintered alloy. The Fe sintered alloy comprises carbon of from 1.2 wt. % to 2.0 wt. %, copper of from over 15.0 wt. % to 25.0 wt. %, and the balance being iron and incidental impurities. A free Cu phase is precipitated in a matrix of the synchronizer ring. The synchronizer ring has a high scuffing resistance, an excellent friction characteristic, and sufficient abrasion resisting property and strength, and moreover, provides an easy manufacture thereof by means of a size working and is stable in quality.

6 Claims, 2 Drawing Sheets

SYNCHRONIZER RING

BACKGROUND OF THE INVENTION

1. Field of the Invention

The present invention relates to a synchronizer ring, and more specifically to a synchronizer ring which has a high scuffing resistance, an excellent friction characteristic, and improved abrasion resisting property and durability, and moreover, provides an easy manufacture thereof and is stable in quality.

2. Description of the Related Art

A synchronizer ring has conventionally been utilized, for example, for a synchromesh transmission.

The synchronizer ring acts as a friction ring performing a synchronous sliding motion with a rotating opposite object member such as a taper cone of a clutch gear and a separating motion from the taper cone, thus significantly serving as a member for rendering equal peripheral speeds of two gears which are to be engaged with each other. There has conventionally known a synchronizer ring having a structure as shown in FIG. 1, in which a plurality of gear teeth 100 to be engaged with a rotating object member are formed on an outermost peripheral surface of the synchronizer ring with equally spaced relationship in the circumferential direction thereof, and a plurality of annular grooves 102 are formed on the inner peripheral surface 101 thereof, which is to be brought into contact with the taper cone, for imparting friction force to the inner peripheral surface 101. Longitudinal grooves 103 for escaping lubricant oil may be formed on the inner peripheral surface 101 of the synchronizer ring so as to intersect the annular grooves 102 as an occasion demands. The synchronizer ring is provided on its outer peripheral surface with key grooves 104 to which a synchronizer key is fitted. Such a synchronizer ring is generally made of brass (Cu—Zn alloy).

In general, the synchronizer ring having such a structure is required to have high mechanical strength and accuracy, and moreover the inner peripheral portion thereof which is to be brought into contact with the rotating object member is required to have an excellent friction characteristic as well as sufficient abrasion resisting property and scuffing resistance. Particularly, in the field of a transmission mechanism for automobiles, it has been required for the synchronizer ring to have further improved friction characteristic and abrasion resisting property, since there has been a demand for reliable operability and high grade and sporty-operational feeling of the transmission mechanism for an automobile along with a recent requirement of the transmission mechanism itself with high grade and high performance.

In accordance with such a requirement, various studies have been made for providing a synchronizer ring having an inner peripheral portion having further improved friction characteristic and abrasion resisting property in comparison with the conventional synchronizer ring made of brass (Cu—Zn alloy).

For example, there is known from Japanese Patent Publication No. 46-15043 a synchronizer ring having an inner peripheral portion on which a layer formed of a composite material in which metal, ceramics and oxide are uniformly mixed, is formed through fusion bonding by means of a thermal spraying method. Furthermore, as a method usable for manufacture of the synchronizer ring, there is also known from German Patent No. 3705661 a method for manufacturing a friction ring having an inner peripheral portion on which there is formed by a flame jetting method a friction lining composed of a sintered powdery material including for example metallic powdery component of 80 wt. % and non-metallic powdery component of 20 wt. %.

Furthermore, there has also been studied a synchronizer ring composed of an Fe sintered alloy, a matrix of which comprises bainite and pearlite, and a free Cu phase.

However, the two conventional synchronizer rings described above (i.e., the conventional synchronizer ring having the inner peripheral portion on which the layer formed of the composite material in which metal, ceramics and oxide are uniformly mixed, is formed through fusion bonding by means of the thermal spraying method, and the other conventional synchronizer ring obtained by the application of the method for manufacturing the friction ring having the inner peripheral portion on which there is formed by the flame jetting method the friction lining composed of the sintered powdery material including metallic powdery component of 80 wt. % and non-metallic powdery component of 20 wt. %.) have not as yet been improved to an extent that necessary friction characteristic and abrasion resisting property could be obtained. Further, in the conventional synchronizer rings, there are problems of degradation of strength due to insufficient diffusion of the respective metallic components, and of unstable quality due to unevenness of quality of materials of the flame-coated film. Moreover, incompletely fused particles, or scattering or rebounding particles in the flame may often be entangled in the surface layer of the flame-coated film, and the adhesion of these particles on the surface layer thereof coarsens the surface of the flame-coated film, with the result that the friction characteristic may easily be changed in the lapse of time, abrasion of parts or elements of a transmission system of an automobile may be caused by particles dropped down from the flame-coated film, and scuffing may easily be caused, thus leading to unfavorable problems. In view of these problems, a grind working or a cut working has been applied to the surface of the flame-coated film for the purpose of improving the surface coarseness or roughness of the flame-coated film to make it smooth. Such workings however have disadvantage of much cost required and uneconomical use of raw materials due to ground or cut portions of the flame-coated film.

The above-described synchronizer ring composed of the Fe sintered alloy which comprises the matrix comprising the bainite and the pearlite, and the free Cu phase, has a higher hardness of at least HRB90 since it contains the bainite, thus making it difficult to apply the synchronizer ring to a size working. In addition, coefficient of dynamic friction of the synchronizer ring should further be improved.

SUMMARY OF THE INVENTION

The present invention was made in view of the above-mentioned circumstances. An object of the present invention is therefore to provide a synchronizer ring which has a high scuffing resistance, an excellent friction characteristic, and sufficient abrasion resisting property and strength, and moreover, provides an easy manufacture thereof by means of a size working and is stable in quality.

For the purpose of attainment of the aforementioned object of the present invention, the synchronizer ring thereof performing synchronous sliding operation with and separating operation from a rotating object member, which is composed of an Fe sintered alloy, is characterized in that:

said Fe sintered alloy comprises:

C : from 1.2 wt. % to 2.0 wt. %,

Cu : from over 15.0 wt. % to 25.0 wt. %, and the balance being iron and incidental impurities; and a free Cu phase is precipitated in a matrix of said synchronizer ring.

It is preferable to apply a steam treatment or the stream treatment and a subsequent blasting treatment to at least inner surface of the synchronizer ring, which is able to come into contact with the object member.

The above-mentioned Fe sintered alloy preferably has a porosity of from 2 vol. % to 12 vol. %.

The synchronizer ring of the present invention is made of an Fe sintered alloy which comprises carbon of from 1.2 wt. % to 2.0 wt. %, copper of from over 15.0 wt. % to 25.0 wt. %, and the balance being iron and incidental impurities; and in the matrix of which a free Cu phase is precipitated. The matrix of the Fe sintered alloy comprises a fine pearlite structure in which the free Cu phase is precipitated. Accordingly, the synchronizer ring has a good abrasion resisting property without adding any elements such as for example Cr, Mo and the like having a function of improving abrasion resisting property. Since the matrix of the Fe sintered alloy contains no bainite, it is easy to apply a size working to the synchronizer ring made of such an Fe sintered alloy. The multiplier effect can be given by the use of the combination of the fine pearlite structure and the free Cu phase to stabilize the friction characteristic of the synchronizer ring, thus obtaining a high coefficient of dynamic friction ($\mu$) of at least 0.13. Accordingly, the synchronizer ring made of such an Fe sintered alloy has an improved friction characteristic and an improved scuffing resistance.

DETAILED DESCRIPTION OF THE PREFERRED EMBODIMENTS

Figure 1:
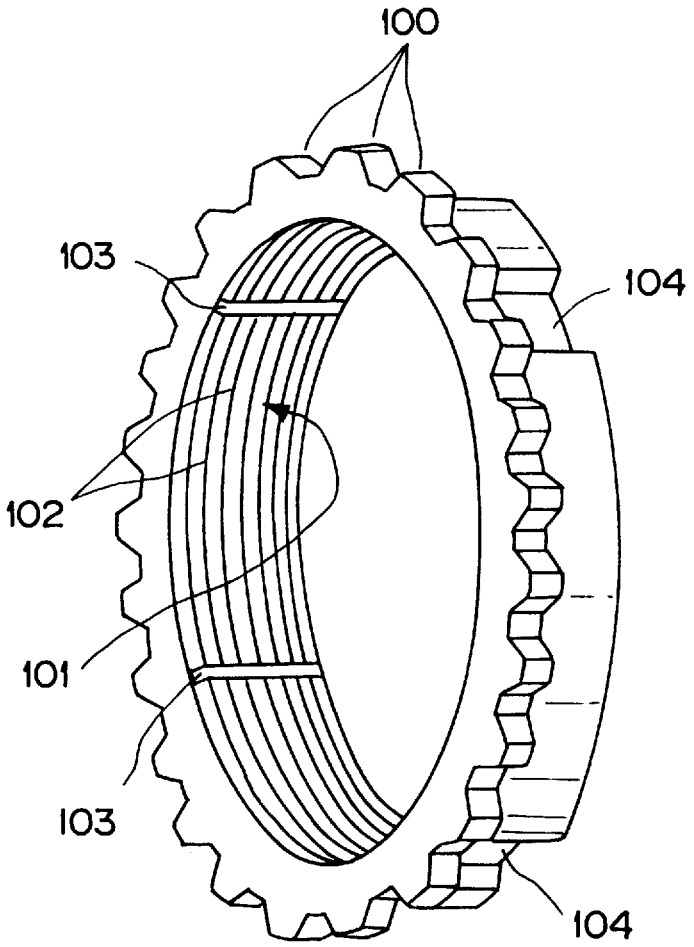
FIG. 1 is a perspective view illustrating a typical example of a synchronizer ring.

Now, chemical composition and other features of an Fe sintered alloy of which a synchronizer ring of the present invention is made will be described in detail below.

(a) Carbon (C)

An Fe sintered alloy of which a synchronizer ring of the present invention is made, has a carbon content of from 1.2 wt. % to 2.0 wt. %. Carbon has a function of improving strength and abrasion resisting property of the Fe sintered alloy. With a carbon content of under 1.2 wt. %, ferrite may precipitate, leading to an insufficient strength of the Fe sintered alloy, and there may occur no precipitation of cementite, thus making it impossible to obtain a fine pearlite structure, with the result that the abrasion resisting property may not be sufficiently improved. With a carbon content of over 2.0 wt. %, on the other hand, a liquid phase tends to be easily produced, thus leading to degradation of measurement accuracy of the synchronizer ring, and increasing an object-attacking property.

(b) Copper (Cu)

The Fe sintered alloy of which the synchronizer ring of the present invention is made, has a copper content of from over 15.0 wt. % to 25.0 wt. %. Copper has a function of causing a free Cu phase to precipitate in a pearlitic matrix structure so as to increase a dynamic frictional force. Copper having such a function diffuses into an iron powder at a temperature equal to or over a melting point of copper, thus dissolving into the matrix while forming diffusion pores therein. An upper limit of an amount of copper to be dissolved into an $\alpha$-Fe is about 8 wt. %. When the copper content is under 8 wt. %, there may therefore be no precipitation of a free Cu phase. In view of this fact, the copper content should be at least 8 wt. %. However, with a copper content of up to 15.0 wt. %, the scuffing resistance may not be sufficiently improved. Therefore, the lower limit of the copper content of the Fe sintered alloy of which the synchronizer ring of the present invention is made, should be over 15.0 wt. %. When the Fe sintered alloy has a copper content higher than 15.0 wt. %, the scuffing resistance can be improved, and mechanical properties such as tensile strength and toughness may however be deteriorated. For the purpose of improvement of the scuffing resistance, it is therefore necessary to increase the copper content and the density of the Fe sintered alloy to be obtained, to prevent the degradation of the mechanical properties such as tensile strength and toughness. With a copper content of over 25 wt. %, it is however impossible to prevent the tensile strength from being degraded, even when increasing the density of the Fe sintered alloy to be obtained. Therefore, the upper limit of the copper content of the Fe sintered alloy of which the synchronizer ring of the present invention is made, should be 25.0 wt. %. In order to cause the free Cu phase to precipitate in the fine pearlitic matrix structure, a Cu alloy may be mixed if an occasion demands. Such a Cu alloy may comprise a Cu—Zn alloy, a Cu—Sn alloy or the like.

(c) Others

① Steam treatment

It is necessary to impart a frictional force to the synchronizer ring, especially to the inner surface thereof which is brought into contact with a taper cone as an object member, and this inner surface should further have a high abrasion property. There exist fine uneven portions and numerous cavities on the inner surface of the synchronizer ring of the present invention which is made of the aforementioned Fe sintered alloy, and as a result, the inner surface thereof has a surface roughness of from 8 to 15 $\mu$mRz. When a steam treatment is applied to the inner surface of the synchronizer ring at a temperature of from 550° C. to 600° C. for a period of time of from 30 to 90 minutes, there can be formed on the fine uneven portions thereof an $Fe_3O_4$ film provided with numerous cavities having an inner diameter of about 1 $\mu$m, with the result that the inner surface thereof has a surface roughness of from about 20 to 25 $\mu$m Rz and a hardness of about Hv 500.

When the steam treatment is applied to the inner surface of the synchronizer ring in this manner, the surface roughness thereof is increased, leading to the formation of a thin oil film on the inner surface thereof being brought into contact with the object member. As a result, a boundary lubrication condition (i.e., metal to metal-contacting condition) is easily produced, and this condition can be maintained for a long period of time, thus making it possible to increase coefficient of friction.

② Blasting treatment

When the inner surface of the synchronizer ring is subject not only to the steam treatment, but also to the blasting treatment, an oil film formed on the inner surface thereof tends to be easily broken, and in addition, there are securely formed passages for discharging oil, thus making it easy to produce the boundary lubrication condition between the inner surface thereof and the object member. When the blasting treatment is applied to the inner surface of the synchronizer ring, the tips of projections of the uneven portions formed on the inner surface thereof tend to be easily and elastically deformed, with the result that an actual contact area between the inner surface of the synchronizer ring and the outer surface of the object member is increased, thus further increasing the frictional force therebetween.

③ Porosity

It is necessary to impart a frictional force to the synchronizer ring, especially to the inner surface thereof which is brought into contact with a taper cone as the object member, and this inner surface should further have a high abrasion property, as described above. A lower porosity of the Fe sintered alloy would provide a good abrasion resisting property, whereas a higher porosity thereof would provide a good friction characteristic. In view of these aspects, at least inner surface of the synchronizer ring of the present invention preferably has the porosity within a range of from 2 vol. % to 12 vol. %. With a porosity thereof of under 2 vol. %, a sufficient frictional force may not be imparted to the inner surface of the synchronizer ring, which is to be brought into contact with the taper cone as the object member. With a porosity thereof of over 12 vol. %, there is a tendency of degradation of strength and abrasion resisting property of the synchronizer ring. The porosity of the Fe sintered alloy may be adjusted within the above-described range by blending powdery graphite, Cu powder and Fe powder each having a particle size of up to 150 mesh in a prescribed blending ratio, mixing these materials in normal conditions to prepare a mixture, applying a pressing treatment to the thus prepared mixture at a pressure of from about 4.5 to 6.5 ton/cm$^2$ to prepare a green compact, and sintering the thus prepared green compact at a temperature of from about 1000° to 1200° C. to form a sintered body.

④ Area ratio of the free Cu phase

In the synchronizer ring of the present invention, the area ratio of the free Cu phase precipitated in the fine pearlitic matrix structure is normally limited within a range of from 6 to 12 area %. With an area ratio of the free Cu phase of under 6 area %, a sufficient dynamic frictional force may not be imparted to the inner surface of the synchronizer ring, which is brought into contact with the taper cone as the object member. With an area ratio thereof of over 12 area %, there is a tendency of degradation of strength and toughness of the synchronizer ring. The synchronizer ring in which the area ratio of the free Cu phase is limited within the above-mentioned range, normally has coefficient of dynamic friction of from 0.130 to 0.149.

⑤ Density

The Fe sintered alloy of which the synchronizer ring of the present invention is made, normally has a density of from 7.0 to 7.3 g/cm$^3$. With a density of the Fe sintered alloy of under 7.0 g/cm$^3$, it may be impossible to prevent the degradation of mechanical properties such as tensile strength and toughness along with the increase in the Cu content. Even when the density of the Fe sintered alloy become higher than 7.3 g/cm$^3$, it may not longer be possible to prevent the degradation of mechanical properties such as tensile strength and toughness along with the increase in the Cu content.

EXAMPLES

Now, the present invention will be described hereinbelow in more detail with reference to Experiment Examples and Comparative Examples.

Experiment Example 1

As powdery raw materials, there were prepared powdery graphite, Cu powder and Fe powder each having a particle size of up to 150 mesh. These powdery raw materials having a blending ratio as shown in Table 1 below were mixed in normal mixing conditions to prepare a powdery mixture. The thus prepared powdery mixture was subjected to a press forming process at a pressure of 6 ton/cm$^2$, to form a green compact. The green compact was sintered at a temperature of from 1000° to 1200° C. for a period of time of 80 minutes in decomposed ammonia gas to prepare a test piece for a synchronizer ring made of a sintered body having substantially the same chemical composition as the blended composition of the powdery raw materials.

TABLE 1

| | Blended composition (wt. %) | | | Porosity | Free Cu ratio | |
|---|---|---|---|---|---|---|
| | C | Cu | Fe and impurities | (vol. %) | (area %) | Hardness (HRB) |
| Experiment Example 1 | 1.5 | 15.5 | Balance | 6 | 7 | 77 |
| Experiment Example 2 | 1.5 | 17.0 | Balance | 6 | 8 | 77 |
| Experiment Example 3 | 1.5 | 22.0 | Balance | 6 | 10 | 76 |
| Comparative Example 1 | 0.89 | 10.0 | Balance | 6 | 5 | 74 |

For the above-mentioned test piece, tests for a hardness (i.e., a sizing workability), a friction characteristic, an amount of abrasion, a surface pressure at which scuffing occurred, and a tensile strength were made, and evaluation for these characteristics was made on the basis of methods described below. The result of the test for the hardness is also shown in Table 1, and the results of the tests for the remaining characteristics are shown in Table 2.

TABLE 2

| | Friction characteristic (dynamic $\mu$) | | Amount | Surface pressure at which | | Den- |
|---|---|---|---|---|---|---|
| | Press load 25 kgf | Press load 80 kgf | of abrasion ($\mu$m) | scuffing occurs (kgf/cm$^2$) | Tensile strength (kgf/cm$^2$) | sity (g/cm$^3$) |
| Experiment Example 1 | 0.134 | 0.138 | 18 | 60 | 52 | 7.2 |
| Experiment Example 2 | 0.134 | 0.138 | 18 | 65 | 52 | 7.2 |
| Experiment Example 3 | 0.136 | 0.140 | 18 | 80 | 53 | 7.3 |
| Comparative Example 1 | 0.123 | 0.117 | 20 | 40 | 60 | 7.2 |

A hardness of the test piece was measured by means of a micro Vickers hardness meter.

Figure 2:
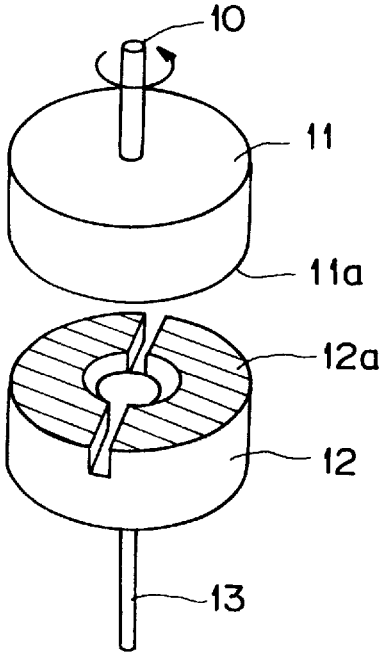
FIG. 2 is a schematic descriptive view illustrating a cylinder to cylinder-plane contacting type friction testing apparatus.

A friction characteristic and an amount of abrasion of the test piece were obtained by measuring coefficient of friction and an amount of abrasion thereof with the use of a cylinder to cylinder-plane contacting type friction testing apparatus as shown in FIG. 2 under the following conditions:

Press load: 25 kgf and 80 kgf

Sliding velocity: 1 m/second

Lubricating oil as used: SAE75w-90

Temperature of the lubricating oil: 90° C.

Oil supplying method: Immersion type

Object member as used: SCM420 subjected to a carburizing hardening and a tempering (with the surface having a hardness of Hv (0.1)600)

A surface pressure at which scuffing occurred was measured by means of the friction testing apparatus as shown in FIG. 2 under the following conditions:

Sliding velocity: 4 m/second

Press load: Pressure was applied to the test piece while increasing the pressure in a increasing ratio of 100N/minute until scuffing occurred.

A tensile strength of the test piece was measured on the basis of TEST PIECE JPMA M06-1992 No. 2 with the use of an Amsler type universal testing machine.

In the cylinder to cylinder-plane contacting type friction testing apparatus as shown in FIG. 2, 10 is a rotatable shaft, 11 is an object member, 11*a* is a sliding surface of the object member, 12 is a test piece made of the sintered body, 12*a* is a sliding surface of the test piece and 13 is a stationary shaft.

Experiment Examples 2 and 3

Test pieces for a synchronizer ring made of a sintered body were prepared in the same manner as in the Experiment Example 1 except that the blending compositions of the powdery raw materials were changed on the basis of ratios as shown in Table 1. For each of the above-mentioned test pieces, tests for a hardness (i.e., a sizing workability), a friction characteristic, an amount of abrasion, a surface pressure at which scuffing occurred, and a tensile strength were made, and evaluation for these characteristics was made in the same manner as in the Experiment Example 1. The result of the test for the hardness is also shown in Table 1, and the results of the tests for the remaining characteristics are shown in Table 2.

Experiment Example 4

A sintered body was prepared in the same manner as in the Experiment Example 1, and the thus prepared sintered body was subjected to a steam treatment at a temperature of 550° C. for a period of time of 30 minutes to prepare a test piece for a synchronizer ring. For this test piece, a surface pressure at which scuffing occurred was measured in the same manner as in the Experiment Example 1. The measured value of the surface pressure at which the scuffing occurred was 85 kgf/cm$^2$.

Experiment Example 5

A sintered body was prepared in the same manner as in the Experiment Example 1, and the thus prepared sintered body was subjected to a steam treatment at a temperature of 550° C. for a period of time of 30 minutes and a subsequent blasting treatment to prepare a test piece for a synchronizer ring. For this test piece, a surface pressure at which scuffing occurred was measured in the same manner as in the Experiment Example 1. The measured value of the surface pressure at which the scuffing occurred was 78 kgf/cm$^2$.

Comparative Example 1

A test piece for a synchronizer ring made of a sintered body was prepared in the same manner as in the Experiment Example 1 except that the blending composition of the powdery raw material was changed on the basis of a ratio as shown in Table 1. For the above-mentioned test piece, tests for a hardness (i.e., a sizing workability), a friction characteristic, an amount of abrasion, a surface pressure at which scuffing occurred, and a tensile strength were made, and evaluation for these characteristics was made in the same manner as in the Experiment Example 1. The result of the test for the hardness is also shown in Table 1, and the results of the tests for the remaining characteristics are shown in Table 2.

As is clear from Table 2, the test pieces for the synchronizer ring according to the Experiment Examples 1 to 3 revealed stable coefficient of dynamic friction in both cases of the press load of 25 kgf (to perform synchronization in relatively short period of time) and of the press load of 80 kgf (to perform synchronization in relatively long period of time), and revealed a high surface pressure at which scuffing occurred.

On the contrary, the test piece for the synchronizer ring according to the Comparative Example 1 revealed coefficient of dynamic friction of 0.123 in case of the press load of 25 kgf (to perform synchronization in relatively short period of time) and revealed coefficient of dynamic friction of 0.117 in case of the press load of 80 kgf (to perform synchronization in relatively long period of time), thus exhibiting unstable synchronizing ability, and revealed a lower surface pressure at which scuffing occurred, than that of the test pieces for the synchronizer ring according to the Experiment Examples 1 to 3.

The test piece for the synchronizer ring according to the Experiment Example 4 revealed a higher surface pressure at which scuffing occurred, than that of the test pieces for the synchronizer ring according to the Experiment Examples 1 to 3. The test piece for the synchronizer ring according to the Experiment Example 5 revealed the surface pressure at which scuffing occurred, which fully satisfied the standard level. Any one of the test pieces for the synchronizer ring according to the Experiment Examples 1 to 5 revealed a higher surface pressure at which scuffing occurred, than that of the test piece for the synchronizer ring according to the Comparative Example 1, thus exhibiting an excellent scuffing resistance.

According to further investigation, there were recognized the following facts:

(1) When the Cu content was limited to 15.5 wt. %, the area ratio of the free Cu was within a range of from 6 to 10 area %;

(2) When the Cu content was limited to 20 wt. %, the area ratio of the free Cu was within a range of from 8 to 10 area %; and (3) When the Cu content was limited to 25 wt. %, the area ratio of the free Cu was within a range of from 10 to 12 area %.

There were also recognized the following facts:

(1) The free Cu phase was precipitated in the fine pearlite of the matrix;

(2) The free Cu phase had a lower hardness of from 120 to 160, whereas the matrix of the pearlite has a hardness of from 200 to 300; and (3) The free Cu phase serving as a soft material permitted to stabilize the friction characteristic of the synchronizer ring.

The presumption was that the synchronizer ring of the present invention could easily be subjected to the size working due to the above-mentioned precipitation of the free Cu phase.

According to the present invention having the construction as described in detail, it is possible to provide a synchronizer ring which has a high scuffing resistance, an excellent friction characteristic; is excellent in synchronous sliding operation with and separating operation from a taper cone as an object member; provides an easy manufacture thereof by means of a size working without requirement of a grind working or a cut working of the flame-coated film; and is stable in quality.

What is claimed is:

1. A synchronizer ring capable of performing synchronous sliding operation with and separating operation from a rotating object member, said synchronizer ring composed of an Fe sintered alloy in a matrix, wherein:

said Fe sintered alloy comprises:

C: from 1.2 wt % to 2.0 wt %,

Cu: from over 15.0 wt % to 25.0 wt %, and the balance being iron and incidental impurities; and the matrix of said synchronizer ring comprises a fine pearlite structure and a precipitated free copper phase and contains no bainite.

2. A synchronizer ring as claimed in claim 1, wherein:

at least inner surface of said synchronizer ring, which is able to come into contact with said object member, has been subjected to a steam treatment.

3. A synchronizer ring as claimed in claim 2, wherein:

said Fe sintered alloy has a porosity of from 2 vol. % to 12 vol. %.

4. A synchronizer ring as claimed in claim 1, wherein:

at least inner surface of said synchronizer ring, which is able to come into contact with said object member, has been subjected to a steam treatment and a blasting treatment.

5. A synchronizer ring as claimed in claim 4, wherein:

said Fe sintered alloy has a porosity of from 2 vol. % to 12 vol. %.

6. A synchronizer ring as claimed in claim 1, wherein:

said Fe sintered alloy has a porosity of from 2 vol. % to 12 vol. %.

* * * * *